US007794029B2

(12) United States Patent
Peng et al.

(10) Patent No.: US 7,794,029 B2
(45) Date of Patent: Sep. 14, 2010

(54) BALL BEARING SLIDE ASSEMBLY

(75) Inventors: Wen-Tang Peng, Taipei Hsien (TW); Mo-Ming Yu, Shenzhen (CN); Zong-Yuan Li, Shenzhen (CN)

(73) Assignees: Hong-Fu Jin Precision Industry (ShenZhen) Co., Ltd., Shenzhen, Guangdong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 563 days.

(21) Appl. No.: 11/838,237

(22) Filed: Aug. 14, 2007

(65) Prior Publication Data

US 2008/0129170 A1 Jun. 5, 2008

(30) Foreign Application Priority Data

Dec. 1, 2006 (CN) ..... 2006 1 0201191

(51) Int. Cl.
*A47B 88/00* (2006.01)

(52) U.S. Cl. ..... 312/333; 312/334.46

(58) Field of Classification Search ..... 312/333, 312/334.44–334.47, 334.7, 334.11, 334.9, 312/334.17, 334.32, 334.33, 334.38; 384/21
See application file for complete search history.

(56) References Cited

U.S. PATENT DOCUMENTS

| | | | | |
|---|---|---|---|---|
| 4,252,382 | A * | 2/1981 | Thomas | 312/334.17 |
| 6,350,001 | B1 * | 2/2002 | Chu | 312/334.44 |
| 6,464,311 | B2 * | 10/2002 | Liang et al. | 312/334.46 |
| 6,685,288 | B1 * | 2/2004 | MacMillan | 312/334.46 |
| 6,705,689 | B2 * | 3/2004 | Chen et al. | 312/334.46 |
| 6,749,276 | B2 * | 6/2004 | Judge et al. | 312/334.47 |
| 6,820,954 | B2 | 11/2004 | Judge et al. | |
| 6,851,773 | B2 * | 2/2005 | Chen et al. | 312/334.46 |
| 6,860,575 | B2 * | 3/2005 | Chen et al. | 312/334.46 |
| 7,404,611 | B1 * | 7/2008 | Que | 312/334.46 |
| 7,413,269 | B2 * | 8/2008 | Chen et al. | 312/333 |
| 2005/0017614 | A1 * | 1/2005 | Cirocco et al. | 312/333 |
| 2007/0040485 | A1 * | 2/2007 | Tseng et al. | 312/333 |

FOREIGN PATENT DOCUMENTS

| | | | | |
|---|---|---|---|---|
| EP | 107525 | * | 5/1984 | 312/333 |
| TW | 491055 | * | 6/2002 | |

* cited by examiner

*Primary Examiner*—Hanh V Tran
(74) *Attorney, Agent, or Firm*—Frank R. Niranjan

(57) ABSTRACT

A ball bearing slide assembly includes a first slide, a second slide, a slide-aiding member, and a positioning member. The first slide is slidably received in the second slide. The second slide defines a receiving hole. The slide-aiding member is sandwiched between the first slide and the second slide. The slide-aiding member defines a slot. The positioning member is pivotably mounted to the slide-aiding member and forms a positioning tab. The positioning tab extends through the slot of the slide-aiding member for engaging in the receiving hole of the second slide to lock the slide-aiding member with the second slide such that the first slide is slidable inward relative to the second slide without pushing the slide-aiding member inward. The first slide, when slid inward, is capable of pushing the positioning member to disengage the positioning tab from the receiving hole such that the slide-aiding member is slidable relative to the first and second slides.

14 Claims, 5 Drawing Sheets

BALL BEARING SLIDE ASSEMBLY

BACKGROUND

1. Field of the Invention

The present invention relates to ball bearing slide assemblies, and particularly to a ball bearing slide assembly having a positioning device for positioning a slide-aiding member thereof.

2. Description of Related Art

A slide assembly is usually used to connect and guide two articles that may be moved relative to each other, such as a cabinet and a server or a cupboard and a drawer. A conventional three-section slide assembly generally includes an outer slide, an intermediate slide, and an inner slide. For example, the outer slide may be fixed in a cabinet, the inner slide may be fixed at a side of the drawer of the cabinet, and the intermediate slide is received in the outer slide to support the inner slide. The inner slide, the intermediate slide, and the outer slide may be coupled with each other, and the inner slide and the intermediate slide may be moved in the longitudinal axial direction of the outer slide. One or more slide-aiding members, each including ball bearings, may be assembled between the slides, for facilitating the sliding movement of the slides relative to each other. The slide-aiding member can slide between the corresponding slides. However, the inner slide is hard to be inserted into an unfixed slide-aiding member because the slide-aiding member may be pushed to slide along the intermediate slide by an end of the inner slide.

What is desired, therefore, is a slide assembly having a positioning device for its slide-aiding member.

SUMMARY

An exemplary ball bearing slide assembly includes a first slide, a second slide, a slide-aiding member, and a positioning member. The first slide is slidably received in the second slide. The second slide defines a receiving hole. The slide-aiding member is sandwiched between the first slide and the second slide. The slide-aiding member defines a slot. The positioning member is pivotably mounted to the slide-aiding member and forms a positioning tab. The positioning tab extends through the slot of the slide-aiding member for engaging in the receiving hole of the second slide to lock the slide-aiding member with the second slide such that the first slide is slidable inward relative to the second slide without pushing the slide-aiding member inward. The first slide, when slid inward, is capable of pushing the positioning member to disengage the positioning tab from the receiving hole such that the slide-aiding member is slidable relative to the first and second slides.

Other advantages and novel features of the present invention will become more apparent from the following detailed description of an embodiment when taken in conjunction with the accompanying drawings, in which:

DETAILED DESCRIPTION

Figure 1:
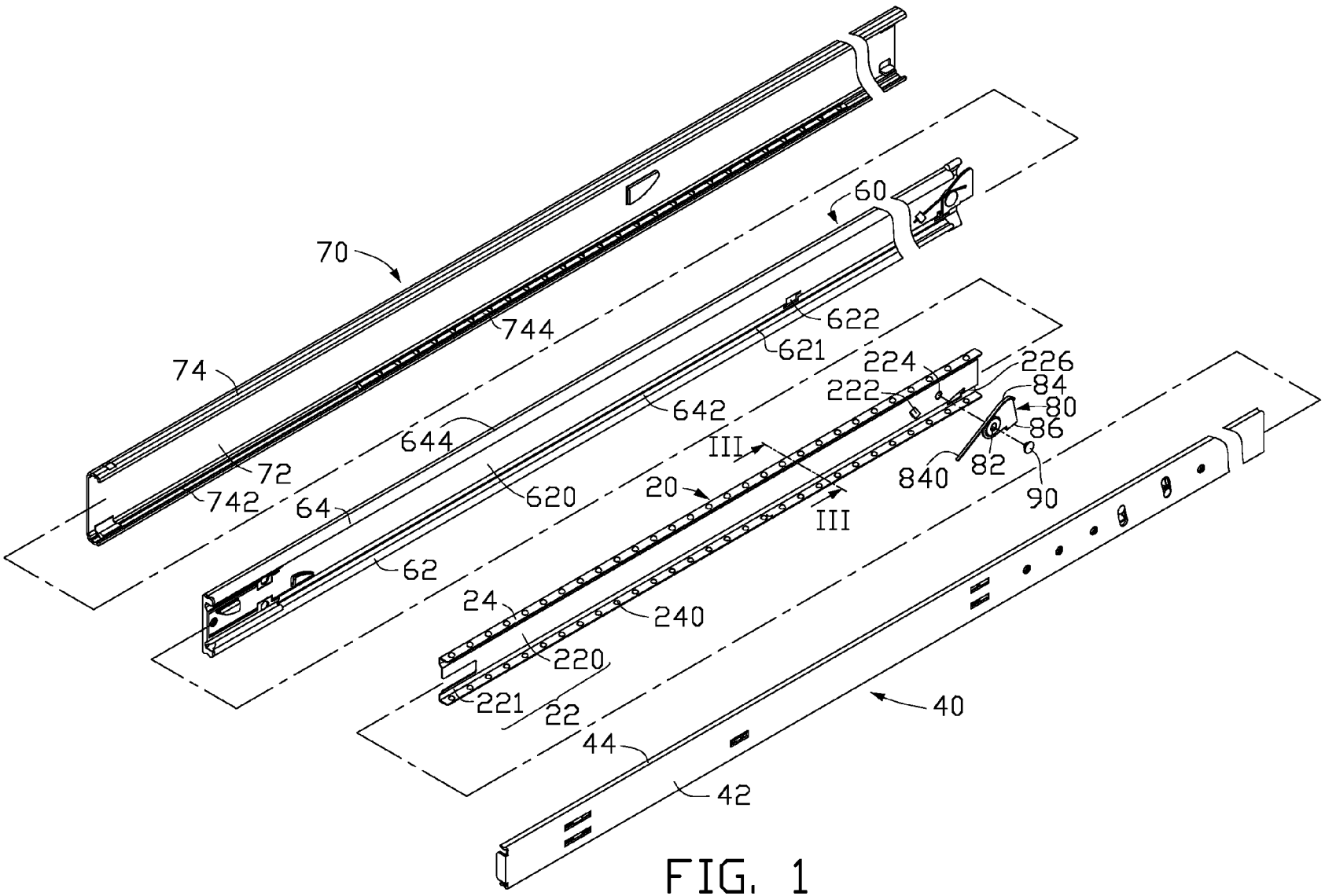
FIG. 1 is an exploded, isometric view of a ball bearing slide assembly with a slide-aiding member in accordance with an embodiment of the present invention.
Figure 2:
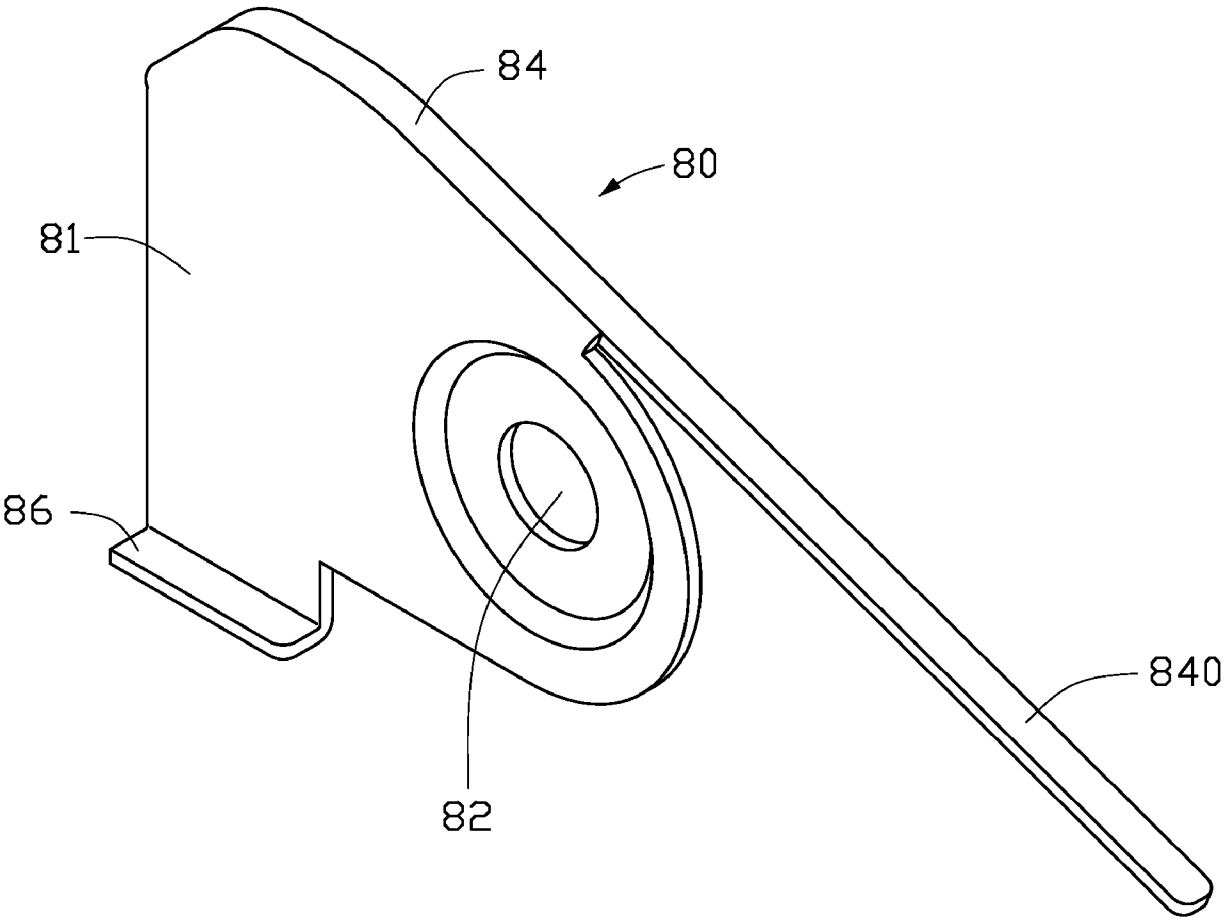
FIG. 2 is an enlarged view of the slide-aiding member of FIG. 1, but viewed from another aspect.
Figure 3:
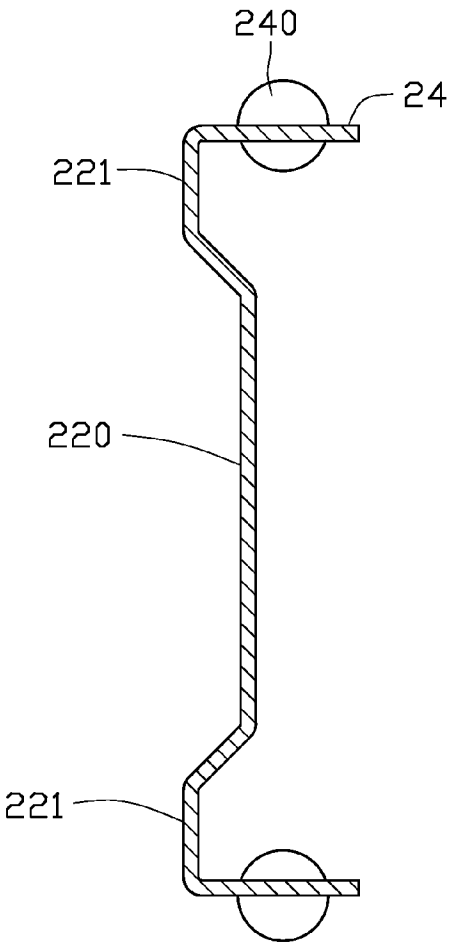
FIG. 3 is a sectional view in an enlarged scale taken along line III-III of FIG. 1.

Referring to FIGS. 1 to 3, a ball bearing slide assembly in accordance with an embodiment of the present invention is shown. The ball bearing slide assembly includes a slide-aiding member 20, a first slide 40, a second slide 60 receiving the first slide 40, a third slide 70 receiving the second slide 60, and a positioning member 80 for positioning the aiding member 20 relative to the second slide 60.

The positioning member 80 includes a plate 81. The plate 81 has an arcuate front side, a straight rear side, a sloping upper side, and an L-shaped lower side. A through hole 82 is defined in the plate 81 adjacent the front side thereof. A slim abutting tab 84 perpendicular to the plate 81 is formed on the upper side of the plate 81. A rear end of the abutting tab 84 is arcuate. A spring clip 840 is formed on a front end of the abutting tab 84, extending forward and downward. The spring clip 840 is generally thin, narrow, and long. A positioning tab 86 perpendicular to the plate 81 extends from the lower side of the plate 81.

The slide-aiding member 20 is sandwiched between the first slide 40 and the second slide 60. The slide-aiding member 20 has a substantially U-shaped cross-section, and includes a web 22, and two arms 24 respectively extending from two lateral edges of the web 22. The web 22 and the arms 24 cooperatively define a receiving space. The web 22 includes a longitudinal base plate 220 with upper and lower troughs 221 located at opposite sides thereof. A cantilevered sloping locking tab 222 is formed on the web 22, adjacent a rear end of the base plate 220. A fixing hole 224 is defined in the base plate 220, between the locking tab 222 and the rear end of the base plate 220, corresponding to the through hole 82 of the positioning member 80. A stepped slot 226 is defined in the web 22, with an upper portion thereof defined in the base plate 220 and a lower portion thereof defined in a junction of the base plate 220 and a lower one of the troughs 221, adjacent the fixing hole 224. The slot 226 corresponds to the positioning tab 86 of the positioning member 80. A plurality of installing holes is defined in each arm 24. A plurality of ball bearings 240 is respectively received in the installing holes, for facilitating the sliding movement of the first slide 40 relative to the second slide 60.

The first slide 40 has a substantially U-shaped cross-section, and includes a web 42, and two arms 44 respectively extending from two lateral edges of the web 42. Each arm 44 is recessed to the opposite arm 44, thereby forming a slide channel in an outer surface thereof, for the ball bearings 240 of the slide-aiding member 20 to slide therein.

The second slide 60 has a substantially U-shaped cross-section, and includes a web 62, and two arms 64 respectively extending from two lateral edges of the web 62. The web 62 and the arms 64 cooperatively define a receiving space for receiving the slide-aiding member 20 and the first slide 40. The web 62 includes a longitudinal base plate 620 with upper and lower troughs 621 located at opposite sides thereof. A stepped receiving hole 622 is defined in the web 62, with an upper portion thereof defined in the base plate 620 and a lower portion thereof defined in a junction of the base plate 620 and a lower one of the troughs 621, at a proper distance from a front end of the web 62. The receiving hole 622 corresponds to the slot 226 of the slide-aiding member 20. Each arm 64 defines an inner channel 642 in an inner surface thereof, and an outer channel 644 in an outer surface thereof.

The third slide 70 has a substantially U-shaped cross-section, and includes a web 72, and two arms 74 respectively extending from two lateral edges of the web 72. The web 72 and the arms 74 cooperatively define a receiving space for receiving the second slide 60. Two or more slide-aiding members 744 are slidably mounted between the third slide 70 and the second slide 60, for facilitating the sliding movement of the second slide 60 relative to the third slide 70.

Figure 4:
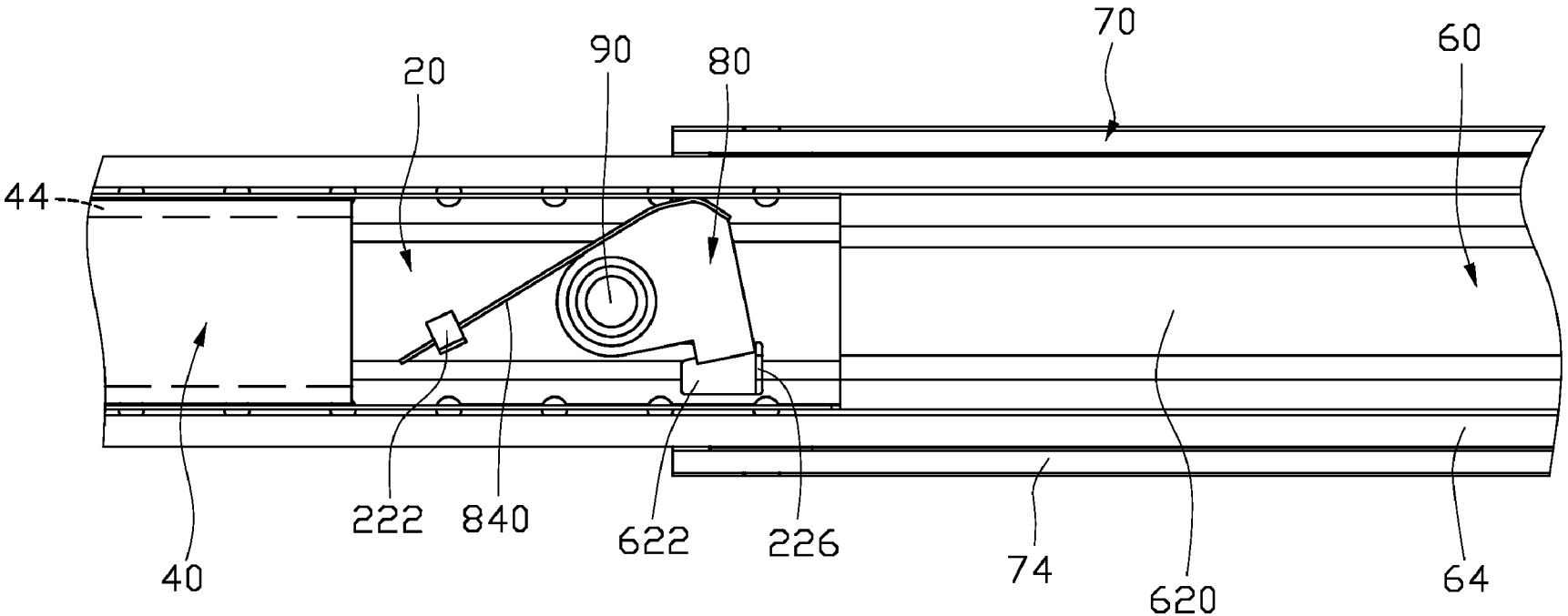
FIG. 4 is an assembled view of FIG. 1, showing the slide-aiding member at a locked position.

Referring to FIG. 4, in assembly, a rivet 90 extends through the through hole 82 of the positioning member 80, and is inserted into the fixing hole 224 of the slide-aiding member 20 to engage with the slide-aiding member 20, whereby the positioning member 80 is pivotably mounted to the rear end of the slide-aiding member 20. The positioning tab 86 of the positioning member 80 extends through the slot 226 of the slide-aiding member 20. The spring clip 840 of the positioning member 80 is deformed to be inserted under and abuts against the locking tab 222. The rear end of the abutting tab 84 of the positioning member 80 abuts against one arm 24 of the slide-aiding member 20. A rear end of the slide-aiding member 20 is inserted into a front end of the second slide 60. The front end of the slide-aiding member 20 is pushed rearward, the slide-aiding member 20 is received in and slides forward along the second slide 60. The ball bearings 240 of the slide-aiding member 20 are received in and slide along the inner channels 642 of the arms 64 of the second slide 60. The positioning tab 86 of the positioning member 80 is received in the lower one of the troughs 621 and abuts against the bottom surface of the base plate 620 of the second slide 60. When the slide-aiding member 20 is pushed to the forefront of the second slide 60, the positioning tab 86 of the positioning member 80 aligns with the lower portion of the receiving hole 622 and is then urged into the upper portion of the receiving hole 622 by the spring clip 840, the positioning tab 86 is locked into the receiving hole 622 of the second slide 60 and blocked by a portion of the base plate 620 adjacent the upper portion of the receiving hole 622, so that the slide-aiding member 20 is positioned at the second slide 60, and cannot be pulled back along the second slide 60. The rear end of the second slide 60 is inserted into a front end of the third slide 70, between the two arms 72 of the third slide 70. A front end of the second slide 60 is pushed rearward, thereby the second slide 60 is received in and slides rearward along the third slide 70. A rear end of the first slide 40 is inserted into the front end of the second slide 60, between the two arms 64 of the second slide 60. A front end of the first slide 40 is pushed rearward, the first slide 40 is received in and slides rearward along the second slide 60. The slide channels of the arms 44 of the first side 40 contact the ball bearings 240 of the slide-aiding member 20 to facilitate the movement of the first side 40.

Figure 5:
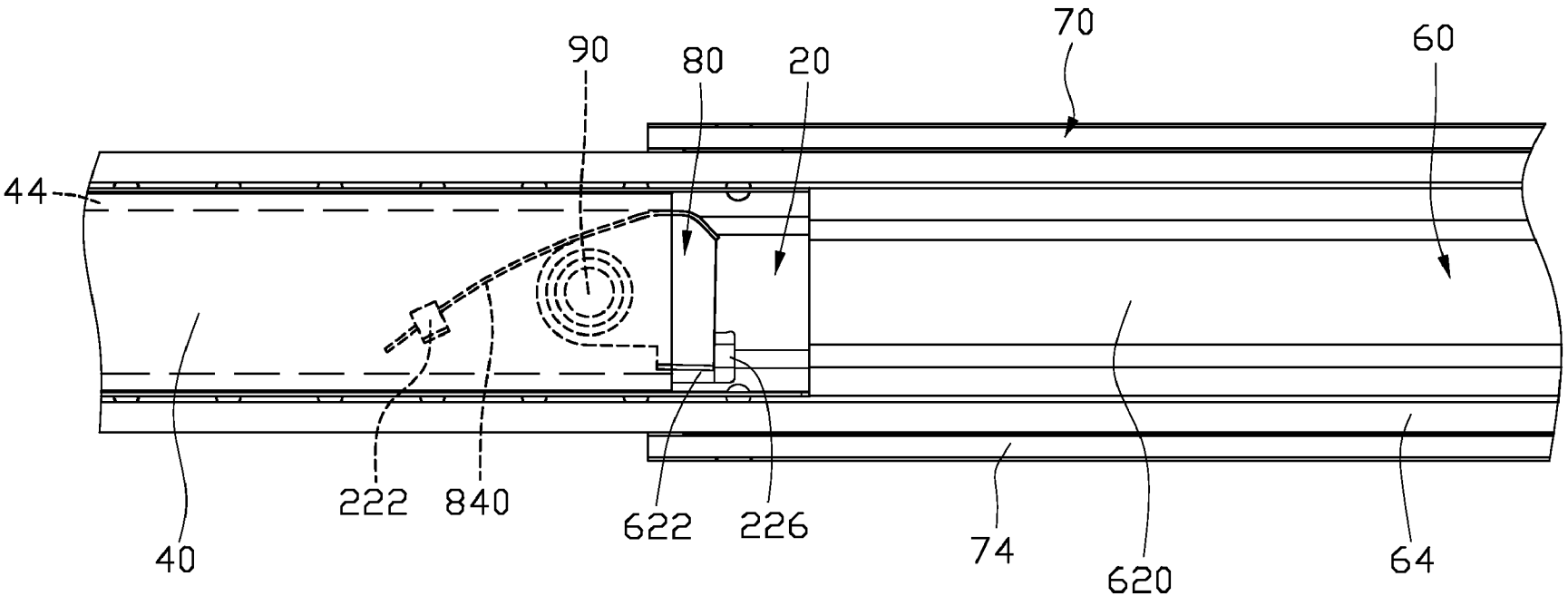
FIG. 5 is similar to FIG. 4, but showing the slide-aiding member at an unlocked position.

Referring to FIG. 5, in the rearward movement of the first side 40 along the second slide 60, the rear end of one arm 44 of the first slide 40 pushes the rear end of the abutting tab 84 of the positioning member 80. The positioning member 80 is driven to pivot around the rivet 90, and the spring clip 840 is deformed. The positioning tab 86 of the positioning member 80 is disengaged from the receiving hole 622 of the second slide 60, and is pushed into the lower one of the troughs 621 of the second slide 60. The slide-aiding member 20 can slide rearward along the second slide 60, together with the first slide 40.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A ball bearing slide assembly, comprising:

a first slide;

a second slide slidably receiving the first slide and defining a receiving hole;

a slide-aiding member comprising a plurality of ball bearings slidably sandwiched between the first slide and the second slide for facilitating the sliding movement of the first slide relative to the second slide, the slide-aiding member defining a slot; and a positioning member pivotably mounted to the slide-aiding member and forming a positioning tab, the positioning tab extending through the slot of the slide-aiding member configured to engage in the receiving hole of the second slide for locking the slide-aiding member with the second slide such that the first slide is slidable inward relative to the second slide without pushing the slide-aiding member inward, the first slide, when slid inward, capable of pushing the positioning member to pivot to disengage the positioning tab of the slide-aiding member from the receiving hole of the second slide such that the slide-aiding member is slidable relative to the first and second slides when the first slide slides relative to the second slide;

wherein the second slide comprises a web and two arms respectively extending from two lateral edges of the web, the web forms a longitudinal base plate and two recessed troughs, an upper portion of the receiving hole is defined in the base plate and a lower portion of the receiving hole is defined in a junction of the base plate and a lower one of the troughs such that the positioning tab is capable of sliding into the lower portion of the receiving hole via the lower one of the troughs to engage in the upper portion of the receiving hole.

2. The ball bearing slide assembly as described in claim 1, wherein the slide-aiding member forms a cantilevered sloping locking tab, the positioning member forms a spring clip, the spring clip is deformably inserted under and abuts against the locking tab for urging the positioning tab to engage in the upper portion of the receiving hole of the second slide.

3. The ball bearing slide assembly as described in claim 1, wherein the first slide comprises two arms configured to slidably contact the ball bearings, the positioning member forms an abutting tab, when the first slide is slid inward, an end of one arm of the first slide pushes the abutting tab to pivot the positioning member.

4. The ball bearing slide assembly as described in claim 1, wherein the positioning member defines a through hole, the slide-aiding member defines a fixing hole corresponding to the through hole of the positioning member, a rivet extends through the through hole of the positioning member, and into the fixing hole of the slide-aiding member to engage with the slide-aiding member such that the positioning member is pivotable about the rivet.

5. The ball bearing slide assembly as described in claim 1, wherein the slide-aiding member comprises a web and two arms respectively extending from two lateral edges of the web, the web forms a longitudinal base plate and two troughs, an upper portion of the slot is defined in the base plate and a lower portion of the slot is defined in a junction of the base plate and a lower one of the troughs.

6. The ball bearing slide assembly as described in claim 5, wherein a plurality of installing holes is defined in the arms of the slide-aiding member, the ball bearings are respectively received in the plurality of installing holes, for facilitating the sliding movement of the first slide relative to the second slide.

7. The ball bearing slide assembly as described in claim 1, further comprising a third slide slidably receiving the second slide and at least one other sliding-aiding member slidably mounted between the third slide and the second slide, for facilitating the sliding movement of the second slide relative to the third slide.

8. A slide assembly comprising:

a first slide comprising a web and two arms respectively extending from two lateral edges of the web;

a second slide receiving the first slide which is movable relative to the second slide in a back-and-forth direction, the second slide comprising a web and two arms respectively extending from two lateral edges of the web thereof;

a slide-aiding member sandwiched between the first slide and the second slide, and comprising a web and two arms respectively extending from two lateral edges of the web thereof , a slot defined in the web of the slide-aiding member; and a positioning member movably mounted to the slide-aiding member and forming a positioning tab, the positioning tab extending through the slot of the slide-aiding member and being capable of engaging with the second slide in a first position for retaining the slide-aiding member to the second slide, and capable of being driven by the first slide to a second position to disengage from the second slide for releasing the slide-aiding member from the second slide without retracting from the slot of the slide-aiding member;

wherein the web of the second slide forms a longitudinal base plate and two troughs, a receiving hole is defined in the web of the second slide, with an upper portion thereof defined in the base plate and a lower portion thereof defined in a junction of the base plate and a lower one of the troughs such that the positioning tab is capable of sliding into the lower portion of the receiving hole via the lower one of the troughs to be urged to engage in the upper portion of the receiving hole by the positioning member.

9. The slide assembly as described in claim 8, wherein a plurality of installing holes is defined in the arms of the slide-aiding member, a plurality of ball bearings is respectively received in the installing holes to slidably contact with the arms of the first and second slides, for facilitating the sliding movement of the first slide relative to the second slide.

10. The slide assembly as described in claim 9, wherein each of the arms of the first slide forms a slide channel in an outer surface thereof, each of the arms of the second slide forms an inner channel in an inner surface thereof, the ball bearings of the slide-aiding member are received in and slidable along the slide channels and the inner channels.

11. The slide assembly as described in claim 8, wherein the web of the slide-aiding member forms a longitudinal base plate and two troughs, an upper portion of the slot is defined in the base plate and a lower portion of the slot is defined in a junction of the base plate and a lower one of the troughs.

12. A slide assembly comprising:

a first slide comprising a web and two arms respectively extending from two lateral edges of the web;

a second slide comprising a web and two arms respectively extending from two lateral edges of the web thereof, the first slide received in the second slide and being slidable relative to the second slide inward and outward;

a slide-aiding member comprising a web located between the webs of the first and second slides, and two arms respectively extending from two lateral edges of the web thereof, a plurality of ball bearings being attached to the arms of the slide-aiding member and slidably sandwiched between the arms of the first and second slides for facilitating the sliding movement of the first slide relative to the second slide; and a positioning member movably mounted to one of the slide-aiding member and the second slide, the positioning member comprising a positioning tab and the positioning tab being capable of engaging with the other one of the slide-aiding member and the second slide for locking the slide-aiding member with the second slide such that the first slide is slidable inward relative to the second slide without pushing the slide-aiding member inward, and being driven by the first slide, when the first slide is slid inward, to disengage from the other one of the slide-aiding member and the second slide for unlocking the slide-aiding member from the second slide such that the slide-aiding member is slidable relative to the first and second slides when the first slide slides relative to the second slide;

wherein the web of the second slide forms a longitudinal base plate and two recessed troughs, and defines a receiving hole, the receiving hole comprising an upper portion defined in the base plate and a lower portion defined in a junction of the base plate and a lower one of the troughs such that the positioning tab of the positioning member is capable of sliding into the lower portion of the receiving hole via the lower one of the troughs to be urged to engage in the upper portion of the receiving hole.

13. The slide assembly as described in claim 12, wherein the positioning member is movably mounted to the slide-aiding member and the positioning tab extending through the web of the slide-aiding member and configured to engage with the second slide.

14. The slide assembly as described in claim 13, wherein the slide-aiding member forms a cantilevered slanted locking tab, the positioning member forms a spring clip, and the positioning member is pivotably mounted to the slide-aiding member with the spring clip being inserted under and abutting against the locking tab for urging the positioning tab to engage with the second slide.

* * * * *